US006523624B1

(12) United States Patent
Cousins et al.

(10) Patent No.: US 6,523,624 B1
(45) Date of Patent: Feb. 25, 2003

(54) SECTIONAL DRIVE SYSTEM

(76) Inventors: James E. Cousins, 1821 Bayou Dr., Shreveport, LA (US) 71105; Ruben C. Boyter, 9400 Dean Rd., Shreveport, LA (US) 71118

( * ) Notice: Subject to any disclaimer, the term of this patent is extended or adjusted under 35 U.S.C. 154(b) by 2 days.

(21) Appl. No.: 09/758,297

(22) Filed: Jan. 10, 2001

(51) Int. Cl.[7] ..... E21B 10/26

(52) U.S. Cl. ..... 175/386; 175/78; 175/320; 175/426

(58) Field of Search ..... 175/320, 386, 175/385, 426, 78, 101, 73

(56) References Cited

U.S. PATENT DOCUMENTS

| | | | | | |
|---|---|---|---|---|---|
| 1,367,042 | A | | 2/1921 | Granville | |
| 2,516,421 | A | | 7/1950 | Robertson | 255/1.6 |
| 2,539,047 | A | | 1/1951 | Arutunoff | 255/1.6 |
| 2,726,847 | A | | 12/1955 | McCune | 255/1.6 |
| 2,778,603 | A | | 1/1957 | McCune | 255/1.6 |
| 3,667,556 | A | | 6/1972 | Henderson | 175/73 |
| 3,903,974 | A | | 9/1975 | Cullen | 175/17 |
| 3,958,649 | A | | 5/1976 | Bull et al. | 175/61 |
| 4,007,797 | A | * | 2/1977 | Jeter | 175/26 |
| 4,051,908 | A | | 10/1977 | Driver | 175/78 |
| 4,185,705 | A | | 1/1980 | Bullard | 175/78 |
| 4,368,786 | A | | 1/1983 | Cousins | 175/78 |
| 4,442,908 | A | | 4/1984 | Steenbuck | 175/74 |
| 4,454,922 | A | * | 6/1984 | Jamison et al. | 175/323 |
| 4,601,353 | A | | 7/1986 | Schu et al. | 175/41 |
| 4,625,815 | A | | 12/1986 | Spies | 175/73 |
| 4,658,816 | A | | 4/1987 | Bond | 175/81 |
| 4,699,224 | A | | 10/1987 | Burton | 175/61 |
| 4,880,067 | A | | 11/1989 | Jelsma | 175/107 |
| 5,337,839 | A | | 8/1994 | Warren | 175/62 |
| 5,373,906 | A | | 12/1994 | Braddick | 175/67 |
| 5,392,858 | A | | 2/1995 | Peters et al. | 166/298 |
| 5,413,184 | A | | 5/1995 | Landers | 175/62 |
| 5,699,866 | A | | 12/1997 | Cousins et al. | 175/78 |
| 5,853,056 | A | * | 12/1998 | Landers | 175/424 |
| 5,911,283 | A | | 6/1999 | Cousins et al. | 175/78 |
| 6,283,230 | B1 | * | 9/2001 | Peters | 175/67 |
| 6,378,629 | B1 | * | 4/2002 | Baird | 175/75 |

* cited by examiner

*Primary Examiner*—David Bagnell
*Assistant Examiner*—Zakiya Walker
(74) *Attorney, Agent, or Firm*—John M. Harrison

(57) ABSTRACT

A sectional drive system for transmitting rotational power to an output, which system includes multiple splined drive segments which are nested and interlocked as a drive string that is rotatable in a selected straight or curved path. The top one of the drive segments cooperates with a drive mechanism to effect rotation of the nested drive segments in concert, and the bottom one of the drive segments connects to a suitable output such as a drill bit. Multiple, tapered and truncated exterior splines on each of the drive segments mesh with complementary interior splines on the adjacent drive segment to enable slight angular positioning of the drive segments on each other and facilitate dampening of drive vibration and bending of the drive string in or out of the chosen path in any desired direction as the drive string transmits rotational power in a curved path of desired magnitude from the drive mechanism to the output. The drive segments are typically connected internally by means of a cable or shaft, or may be connected by floating "collars", to form the drive string. In a preferred embodiment, a drill bit having a removable center bit insert is mounted on the bottom one of the drive segments on the drive string, and is characterized by multiple interior splines which engage the companion exterior splines of the drive segment.

41 Claims, 5 Drawing Sheets

SECTIONAL DRIVE SYSTEM

BACKGROUND OF THE INVENTION

1. Field of the Invention

This invention relates to drive systems for transmitting rotational power to an output and more particularly, to a sectional drive system which is characterized by multiple, splined, interlocking drive segments that each include truncated and tapered exterior splines extending from one surface of a round segment base and interior splines extending from the opposite surface of the segment base and having interior spline seats located between the interior splines, which interior spline seats are substantially complementary to the configuration of the exterior splines. The drive segments are nested and interlocked by inserting the exterior splines of one drive segment in the congruent interior spline seats between adjacent interior splines of the adjacent drive segment, and are rotated in concert as a drive string in a selected path. The path may be straight or curved and in the latter case, the interlocking drive segments are capable of slight angular shifting on each other while maintaining a drive configuration of high integrity to dampen the drive vibration, define the chosen curved drive path and facilitate transmission of rotation from a drive mechanism to an output device with considerable torque and thrust. The nested drive segments can be interconnected interiorly by means of a cable or rod or exteriorly by floating collars and therefore, can be used as a drive train in any application in which a transfer of rotation is required in a straight line or at substantially any angle or deviation from a straight line. The sectional drive system may, for example, be used to effect horizontal drilling or coring of producing hydrocarbon intervals in oil and gas wells, utilizing the multiple, stacked and tapered, interlocking drive segments driven by a downhole drilling motor at one end of the drive string to operate a drill bit connected to the opposite end of the drive string. Retrieval of the drive string from the interval may be typically facilitated by a cable extended through openings in the drive segments. Consequently, the sectional drive system of this invention can be used in a downhole drilling apparatus to more efficiently effect drilling deviation in a controlled manner from a vertical well bore and provide a primary horizontal deviation or a lateral deviation from an existing vertical well bore. In a preferred embodiment of the invention, a drill bit having a removable center bit insert is mounted on the bottom one of the drive segments on the drive string, and is characterized by multiple interior splines which engage the companion exterior splines of the drive segment.

While capable of being operated in an extremely efficient manner to permit horizontal or angular drilling of drain hole perforations in oil wells, the sectional drive system of this invention can also be implemented to transmit rotational power from substantially any drive system to an output apparatus, drive or other system under circumstances where the rotational power is to be transmitted in an offset or a curved line. Accordingly, the sectional drive system of this invention is preferably designed with truncated drive segments and is capable of being used to transmit rotation from an engine, motor or other power source to automobiles, mud motors and like apparatus and equipment, as well as to dental drills, robotic devices and material-handling equipment, in non-exclusive particular.

2. Description of the Prior Art

Conventional techniques for effecting the transmission of rotational power between a power source and an output under circumstances where the power is to be transmitted in an offset or curved manner, includes the use of coupling mechanisms such as a universal or "CV" joint which are well known to those skilled in the art. For example, many devices have been designed for lowering into an oil or gas well for the purpose of boring and drilling holes at right angles to the well bore at the production interval, but many problems have been encountered using these systems. Typically, the relatively low bit rotational speed generally necessitated by using curved shafts of various design sometimes requires excessive time to achieve significant penetration, and increasing the bit rotational speed and torque load frequently causes failure of the shafts. Accordingly, these conventional horizontal drilling devices have not proved capable of sustaining the high compressive loads necessary to penetrate the well casing, concrete sheath, rock and producing interval in a well within an economical time frame without failure. Other problems have been encountered, such as impediments to bit retrieval and reduced freedom of rotation of the drilling string in such application.

Among the directional drilling apparatus designed to achieve this function are those detailed in the following U.S. Patentes: U.S. Pat. No. 1,367,042, to Granville; U.S. Pat. No. 2,516,421, to Robertson; U.S. Pat. No. 2,539,047, to Arutunoff; U.S. Pat. No. 2,726,847, to McCune; U.S. Pat. No. 2,778,603, to McCune; U.S. Pat. No. 3,667,556, to Henderson; U.S. Pat. No. 3,903,974, to Cullen; U.S. Pat. No. 3,958,649, to Bull et al; U.S. Pat. No. 4,051,908, to Driver; U.S. Pat. No. 4,185,705, to Bullard; U.S. Pat. No. 4,368,986, to Cousins; U.S. Pat. No. 4,442,908, to Stenbock; U.S. Pat. No. 4,601,353 to Schuh et al; U.S. Pat. No. 4,625,815, to Spies; U.S. Pat. No. 4,658,916, to Bond; U.S. Pat. No. 4,699,224, to Burton; U.S. Pat. No. 4,880,067, to Felsma; U.S. Pat. No. 5,337,839, to Warren et al; U.S. Pat. No. 5,373,906, to Braddick; U.S. Pat. No. 5,392,858, to Peters et al; U.S. Pat. No. 5,413,184, to Landers; U.S. Pat. No. 5,699,866, to James E. Cousins et al; U.S. Pat. No. 5,911,283 to James E. Cousins.

It is an object of this invention to provide a sectional drive system for transmitting rotational power in a straight path or a deviated, curved or offset path to an output of selected character.

Another object of this invention is to provide a sectional drive system for transmitting rotational power in a straight path or in a curved path offset from a source of power to an output, which sectional drive system includes multiple, splined, interlocking drive segments that are stacked and nested to rotate as a drive string responsive to application of rotational power to one end of the drive string in order to rotate the output at the opposite end of the drive string.

A still further object of this invention is to provide a sectional drive system of selected length and size, the drive system including multiple, splined, interlocking drive segments which each includes a round segment base having multiple protruding, tapered and truncated exterior splines, as well as alternating interior splines and interior spline seats in the base for receiving the projecting, tapered and truncated exterior splines of an adjacent drive segment. Multiple exterior base splines provided at the bases of the exterior splines on one drive segment engage multiple interior base splines provided on the adjacent drive segment. The drive segments are stacked and nested as a drive string within or without a guide path such as a tube, with the segments typically interconnected by a cable, rod or floating "collar" for dampening drive mechanism vibration and transmitting rotational power between the drive system and an output.

Yet another object of this invention is to provide a sectional drive system having drive segments with asymmetrical splines and coupled to a drill bit for drilling one or more drain holes of selected depth and angle into a producing interval of an oil or gas well to increase the flow of hydrocarbons or gas from the interval into the well bore.

A still further object of this invention is to provide a self-contained sectional drive system characterized by multiple, splined and interlocking drive segments which can be stacked and nested, optionally on a cable, shaft or rod as a drive string, or fitted with locking grooves and cooperating external floating collars, in a straight or curved guide path. One end of the drive string is connected to a drive apparatus such as a mud motor and the opposite end to an output such as a drill bit. The drive string is typically rotated by the mud motor to drill a hole through the well casing, cement sheath and damaged formation and undamaged production formation and increase the flow of hydrocarbons into the well bore of an oil or gas well.

Still another object of the invention is to provide a transverse down-hole drilling system which is self-contained and includes multiple, cable-mounted, splined and interlocking drive segments. The drive segments each have a round base and multiple, asymmetrical, tapered and truncated exterior splines each having a drive face and spline support face of unequal area projecting from one surface of the base, and companion interior spline seats which alternate with interior splines that extend from the opposite surface of the base. The drive segments nest and rotate in concert as a drive string, and adjacent drive segments are capable of pivoting or positioning at an angle on each other in a curved guide path to define a corresponding configuration of the drive string while maintaining an interlocking configuration of high integrity. The curved guide path may be shaped in such a manner as to permit sufficient lateral movement to traverse a path bend at any predetermined angle with an output such as a drill bit attached to the lower end of the string and an input such as a downhole electric or hydraulic drilling motor coupled to the upper end of the drive string for effecting rotation of the drive string and drill bit. The drive segments may be interconnected by means of an internal cable, a rod or shaft or multiple internally-flange floating collars, to define the drive string.

SUMMARY OF THE INVENTION

These and other objects of the invention are provided in a new and improved sectional drive system for transmitting rotational power from a drive source or apparatus of selected character to an output device of selected design, such as a drill bit, in a straight guide path or in a curved guide path in any angle from 0 to 90° under circumstances where the drive apparatus and the output device are misaligned. The sectional drive system is characterized by multiple, splined and interlocking drive segments which typically include eight spaced-apart asymmetrical, tapered and truncated exterior splines extending from one surface of a round base and each having a drive face and an angular spline support face of unequal area. Typically eight asymmetrical interior splines extend from the opposite surface of the base and define interior spline seats between the interior splines for receiving the congruent or complementary exterior splines of an adjacent drive segment in driving relationship. Multiple exterior base splines are provided at the bases of the respective exterior splines, and the exterior base splines of one drive segment mesh with respective interior base splines provided at the extending ends of the respective interior splines of an adjacent drive segment. The drive segments may be optionally slidably mounted on a cable or rod or externally connected by internally flange floating collars mounted in corresponding locking grooves of the drive segments and stacked and nested as a rotatable drive string, one end of which drive string is attached to a drive mechanism and the opposite end to an output device. In a preferred embodiment of the invention, the output device is a drill bit having a removable center bit insert, and is characterized by multiple interior splines which engage the companion exterior splines of the terminal drive segment of the drive string.

BRIEF DESCRIPTION OF THE DRAWINGS

The invention will be better understood by reference to the accompanying drawings, wherein.

DESCRIPTION OF THE PREFERRED EMBODIMENT

Figure 1:
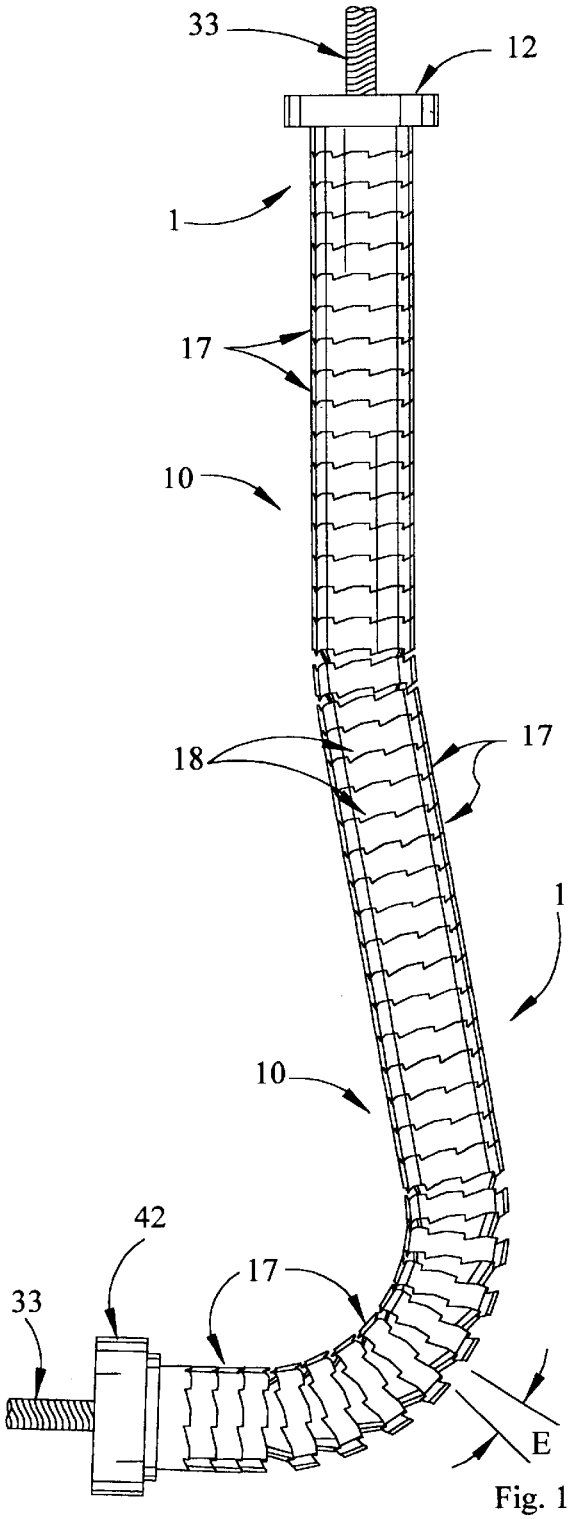
FIG. 1 is a side view of a drive string of a typical sectional drive system of this invention, connected at one end to a suitable drive apparatus for rotating the entire segment string and an output device on the opposite end of the drive string, with the drive segments of the drive string connected by a segment cable.
Figure 2:
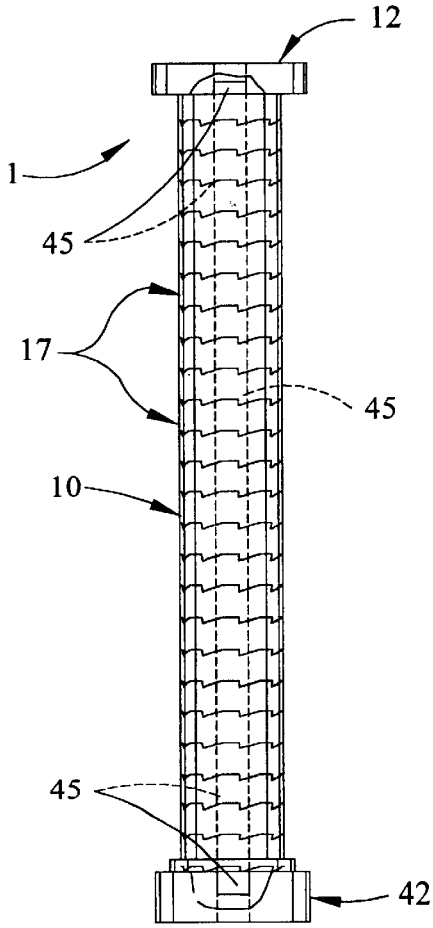
FIG. 2 is a side view of a typical sectional drive system, with the drive segments of the drive string connected by a rod or shaft.
Figure 3:
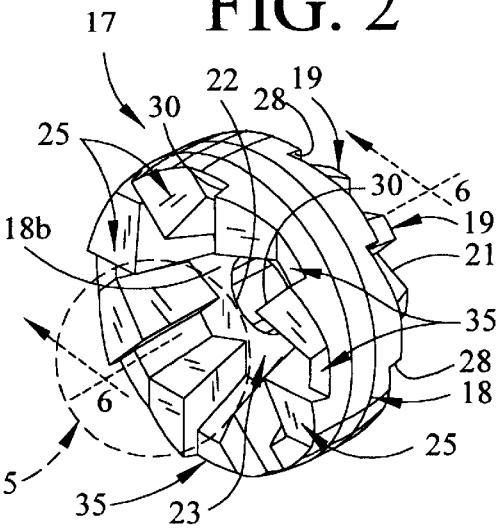
FIG. 3 is a rear perspective view of a typical drive segment element of the sectional drive system illustrated in FIG. 1.
Figure 5:
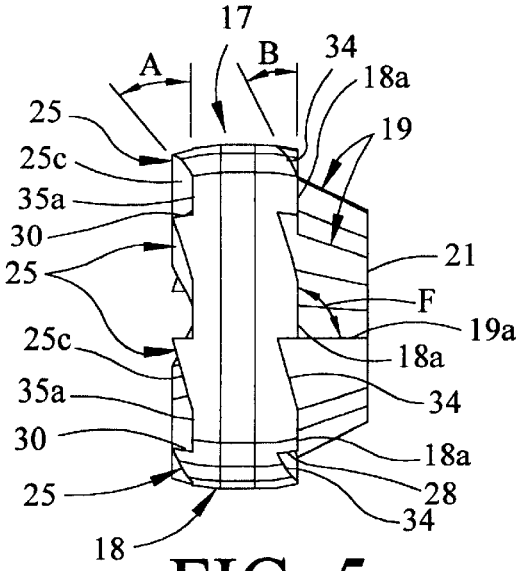
FIG. 5 is a side view of the drive segment illustrated in FIGS. 3 and 4.
Figure 4:
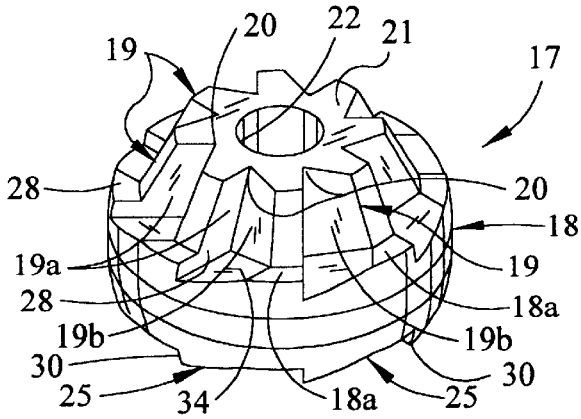
FIG. 4 is a front perspective view of the drive segment element illustrated in FIG. 3.
Figure 6:
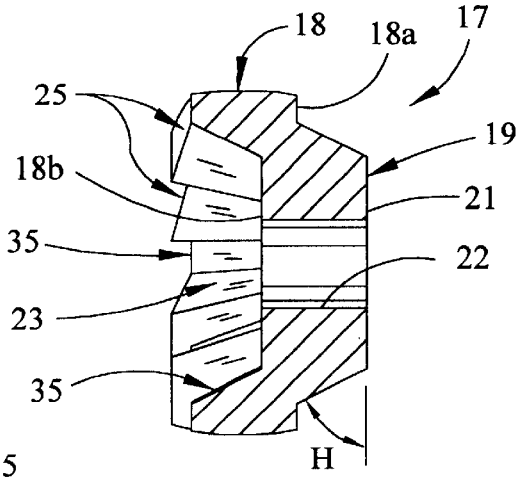
FIG. 6 is a sectional view taken along line 6—6 of the drive segment illustrated in FIG. 3.
Figure 7:
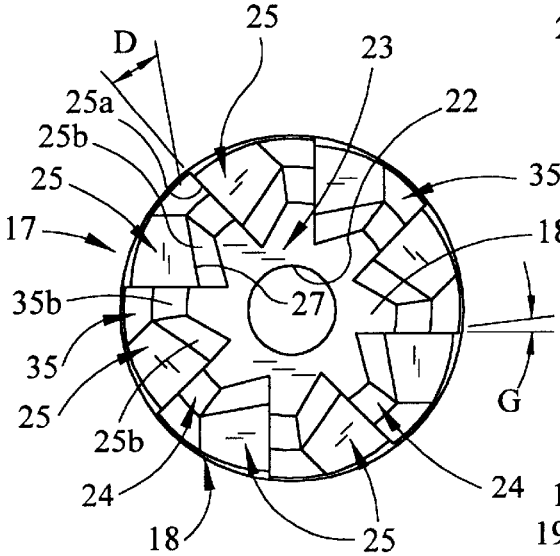
FIG. 7 is a rear view of the drive segment illustrated in FIGS. 3–5, more particularly illustrating the interior splines and intervening interior spline seats of the drive segment.
Figure 8:
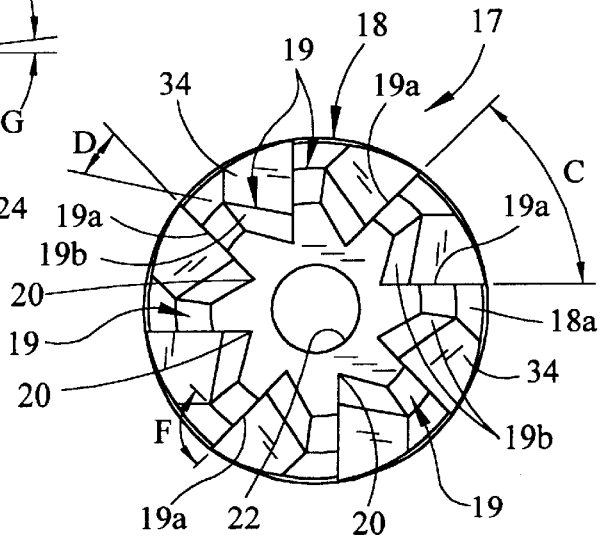
FIG. 8 is a front view of the drive segment illustrated in FIG. 7, more =particularly illustrating the exterior splines and intervening exterior spline seats of the drive segment.

Referring initially to FIGS. 1–8 of the drawings, the sectional drive system of this invention is generally illustrated by reference numeral 1. The sectional drive system 1 is characterized by a drive string 10, formed by stacking multiple, splined drive segments 17 on a segment cable 33, as illustrated in FIG. 1, or alternatively, on an elongated rod or shaft 45, as illustrated in FIG. 2 and hereinafter described. Each of the drive segments 17 includes a flat, disc-shaped segment base 18 and multiple tapered, truncated, asymmetrical exterior splines 19, extending from a flat front base surface 18*a* of the segment base 18, as illustrated in FIGS. 4–6. In a preferred embodiment of the invention, each of the drive segments 17 is shaped to include eight exterior splines 19, each having a drive face 19*a* and an angular spline support face 19*b*. The exterior splines 19 define eight intervening exterior spline slots 20 in a repetitive, geometric pattern which resembles an eight-point star when viewed from the front as illustrated in FIG. 8. As particularly illustrated in FIGS. 4 and 5, each of multiple sloped base surfaces 34 angles into the segment base 18 from the flat front base surface 18*a* to form a sloped boundary of each exterior spline seat 20, and each sloped base surface 34 extends between the spline support face 19*b* of one of the exterior splines 19 and the facing drive face 19*a* of the adjacent exterior spline 19. Each of the sloped base surfaces 34 further defines an exterior base spline 28 at the base of the drive face 19*a* of each exterior spline 19. As illustrated in FIG. 5, the plane of each sloped base surface 34 is disposed at an angle "B" of from about 15 degrees to about 20 degrees, and preferably, about 17 degrees with respect to the plane of the corresponding adjacent front base surface 18 *a*. As illustrated in FIG. 8, the bottom edge of each spline support face 19*b* which meets the corresponding sloped base surface 34 is typically disposed at an angle "D" of from about 10 degrees to about 45 degrees with respect to the bottom edge of the drive face 19*a* for optimum strength. The exterior splines 19 taper from the front base surface 18*a* to a flat truncated tip 21, which is coplanar with the converging sets of exterior splines 19, and a tip aperture 22 is typically provided in the center of the tip 21, as illustrated in FIGS. 3 and 6. As further illustrated in FIG. 8, the angle "C" defined by the drive faces 19*a* of adjacent external splines 19 is typically about 45 degrees for optimum driving characteristics. Moreover, the vertical drive face angle "LF" (FIG. 5) measured between the plane of the front base surface 18 *a* and the plane of the drive face 19*a* of each exterior spline 19, is typically about 90 degrees, whereas the plane of each spline support face 19*b* of each exterior spline 19 is disposed at an obtuse angle with respect to the corresponding sloped base surface 34. As illustrated in FIG. 8, the angle "F" defined by each drive face 19*a* and the flat edge of the corresponding exterior spline 19 is typically about 90 degrees.

Figure 15:
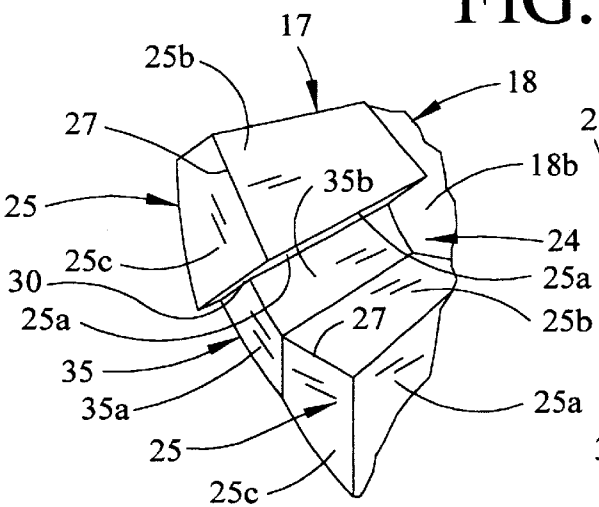
FIG. 15 is an enlarged sectional view, taken along section line 15 in FIG. 3, of a drive section element of the sectional drive system.

Referring again to FIGS. 3–7 and to FIG. 15 of the drawings, multiple interior splines 25 and intervening spline dividers 35 (FIG. 15) extend from the flat rear base surface 18*b* of the segment base 18 of the drive segment 17, to define a central segment interior 23 which communicates with the tip aperture 22 of the drive segment 17 as illustrated in FIG. 6. As illustrated in FIG. 15, each of the interior splines 25 is characterized by a flat drive face 25*a* and a flat spline wall 25*b*. An interior spline seat 24 is defined between adjacent interior splines 25, by the recessed interior divider face 35*b* of each intervening spline divider 35, the drive face 25*a* of one interior spline 25 and the facing spline wall 25*b* of the adjacent interior spline 25*b*. As illustrated in FIG. 5, an exterior spline face 25*c* of each interior spline 25 is disposed at an angle "A" of from about 15 degrees to about 20 degrees and preferably, about 17 degrees, with respect to an exterior divider face 35*a* of the corresponding adjacent spline divider 35, which angle "A" is the same as the angle "B" between each sloped base surface 34 and the front base surface 18 *a*. The sloped exterior spline face 25*c* of each interior spline 25 defines an interior base spline 30 adjacent and substantially perpendicular to each exterior divider face 35*a*. As illustrated in FIG. 7, the plane of the drive face 25*a* of each interior spline 25 is typically disposed at an angle "D" of from about 10 degrees to about 45 degrees with respect to the exterior edge 27 of the facing spline wall 25*b* of the adjacent interior spline 25*b*. The interior splines 25 and intervening spline dividers 35 extend outwardly from the rear base surface 18*b* of the segment base 18, to substantially conform to the taper angle of the exterior splines 19. Moreover, the exterior splines 19 are complementary in shape to the interior spline seats 24, and the interior splines 25 are complementary in shape to the exterior spline seats 20, respectively. Accordingly, the drive segments 17 will nest, stack and interlock and yet are capable of being positioned at an angle on each other in driving relationship to shape the drive string 10 as illustrated in FIG. 1, with the exterior splines 19 and interior splines 25 of one drive segment 17 inserted in the interior spline seats 24 and exterior spline seats 20, respectively, of respective adjacent drive segments 17. Furthermore, the exterior base splines 28 of one drive segment 17 engage the respective companion interior base splines 30 of an adjacent drive segment 17. This interlocking registration of the drive segments 17 is not rigid, but permits pivoting movement of the drive segments 17 in the interlocking and nested configuration, such that the drive string 10 can easily bend to conform to the bend illustrated in FIG. 1, and yet maintain an interlocking driving relationship of high integrity due to the drive faces 19*a* of the exterior splines 19 and matching drive faces 25*a* of the interior splines 25*b*. The interlocking registration of the drive segments 19 also serves to dampen any excessive vibration of a mud motor (not illustrated) or other drive mechanism (not illustrated) at the input 12 of the drive string 10.

Referring again to FIGS. 7 and 8 of the drawings, each drive segment 17 is designed such that the internal spline seats 24 are rotatably offset with respect to the respective exterior splines 19 thereof. This offset is preferably at a rotational angle, "G", illustrated in FIG. 7, in the range of from about 0.5 degrees to about 12 degrees and most preferably, about six degrees. This rotational angle "G" facilitates proper meshing of the exterior splines 19 of one drive segment 17 and the interior spline seats 24 of an adjacent drive segment 17 in the drive string 10. In application as hereinafter described, torque is applied to the top of the drive string 10 by means of an input 12 of selected design to rotate the drive string 10 and the output 42 attached to the opposite end of the drive string 10, as further illustrated in FIG. 1.

Referring again to FIG. 6 of the drawings, in a most preferred embodiment of the invention the angle "H" of taper of the spline dividers 35 and the exterior splines 19 with respect to the plane of the truncated tip 21 of the exterior splines 19, is in the range of from about 20 degrees to about 40 degrees and most preferably, about 30 degrees, when one of the drive segments 17 is viewed as illustrated in FIG. 5. This structuring of the drive segment 17 facilitates a drive string 10 which is capable of bending with a separation angle "E", illustrated in FIG. 1, of from about zero to about 10 degrees for each one of the drive segments 17 utilized in the drive string 10, to facilitate traversal of the bend illustrated in FIG. 1 and yet maintain optimum interlocking contact between the exterior splines 19 of each drive segment 17 and interior splines 25 of the adjacent drive segment 17, to effect driving rotation of the selected output 42 responsive to power applied to the drive string 10 by the selected input 12.

Referring now to FIGS. 1 and 2 of the drawings, in a preferred embodiment of the invention a set of drive segments 17 may be slidably strung on the flexible segment cable 33 (FIG. 1) or on the stiff segment shaft 45 (FIG. 2) and nested with each other, with the exterior splines 19 (FIGS. 4 and 5) of each drive segment 17 inserted in the respective interior spline seats 24 (FIG. 15) of the adjacent drive segment 17, and the exterior base splines 28 engaging the respective interior base splines 30. One end of the segment cable 33 or the segment shaft 45 may be fitted with a cable stay or anchor (not illustrated) or otherwise fixed inside the output 42 and the other end threaded through the registering tip apertures 22 of the nested drive segments 17 for similar attachment to the input 12 to maintain the drive segments 17 in nested configuration in the drive string 10. The drive string 10 utilizing the straight rod or shaft 45 illustrated in FIG. 2 is typically rotated in a straight guide path or tube of selected design under circumstances in which the input 12 is in an aligned position with respect to the output 42, with the drive faces 19*a* (FIG. 4) of the exterior splines 19 on one of the drive segments 17 engaging the drive faces 25*a* (FIG. 15) of the respective interior splines 25 of an adjacent drive segment 17, and the exterior base splines 28 engaging the respective interior base splines 30. Alternatively, the drive string 10 can be rotated in a curved guide path or tube of desired curvature under circumstances in which the input 12 is disposed in an offset position with respect to the output 42, as illustrated in FIG. 1. When the output 42 is configured as a drill bit, for example, one or more lateral or horizontal drain holes (not illustrated) can be drilled in a hydrocarbon formation (not illustrated) in a vertical oil or gas well, according to the procedure outlined in U.S. Pat. No. 5,699,866, and the drive string 10 can be retrieved from the drain hole by application of the segment cable 33, illustrated in FIG. 1. In a most preferred embodiment of the invention the drill bit may be typically about twenty percent larger than the drive segment 17 to better facilitate retrieval of the drive string 10 and to facilitate removal of debris from the drain hole as the drive string 10 and the drill bit are removed from the drain hole. In a preferred embodiment of the invention, the tip aperture 22 of each drive segment 17 is about ½" in diameter, whereas the segment cable 33 or shaft 45 is about ½" in diameter to facilitate sufficient clearance between the segment cable 33 or shaft 45 and the edge of the tip aperture 22 for the passage of drill fluid (not illustrated) through the drive segments 17 of the drill string 10 for purposes which will be hereinafter described. It will be further appreciated by those skilled in the art that the drive segments 17 illustrated in FIGS. 1–8 of the drawings may alternatively be used in connection with multiple "floating collars" of the design and in the manner outlined in our U.S. Pat. No. 5,911,283, for the purposes outlined in that patent. Accordingly, under circumstances in which the drive string 10 is to be left in the drain hole and not retrieved and the drive segments 17 are connected by means of the "floating collars", the segment cable 33 may be omitted.

Referring again to FIGS. 7 and 8 of the drawings, it will be further appreciated by those skilled in the art that substantially any number of exterior splines 19, exterior spline seats 20, exterior base splines 28, interior spline seats 24, interior splines 25 and interior base splines 30 can be provided in the design of the drive segment 17. However, in a most preferred embodiment of the invention, eight exterior splines 19, exterior base splines 28 and exterior spline seats 20 and matching interior spline seats 24, interior base splines 30 and interior splines 25 are provided for each one of the drive segments 17, as illustrated. In a most preferred embodiment, the taper of the eight exterior splines 19 and the configuration of the interior splines seats 24 are complementary, as heretofore described, and the exterior splines 19 and interior splines 25 are typically about two percent to about five percent smaller than the interior spline seats 24 and the exterior spline seats 20, respectively, for optimum smoothness and meshing during bending of the drive string 10 while operating the sectional drive system 1 typically as illustrated in FIG. 1.

It will be further appreciated by those skilled in the art that other applications of the sectional drive system 1 may include the application of torque and thrust in a straight line or along a deviation from a straight line up to or even beyond ninety degrees, wherein the drive segments 17 shift or pivot on each other, utilizing either the segment cable 33, the segment shaft 45 or the floating collars (not shown) as described in U.S. Pat. No. 5,911,283, in any desired direction. Torque may also be applied to the drive segments 17 as the latter lie in a curved guide tube or path (not illustrated), as desired. Accordingly, typical applications include "CV" joints and mechanical couplings in vehicles, mud motors and other applications involving misaligned drive and driven systems. Application to dental drills may also be effected under circumstances where the dental drill drive train must be curved over a selected adjustable or fixed radius from the drive motor to the application or drill end. The device may also be used in tools such as flexible-shaft screwdrivers and similar applications, in non-exclusive particular.

It will be appreciated by those skilled in the art that the drive segments 17 can be constructed of substantially any desired material, depending upon the application. Furthermore, the drive segments 17 are typically applied where the deviation, offset or curved between the input 12 and the output 42 of the drive string 10, is significant.

Figures 9, 10, 11:
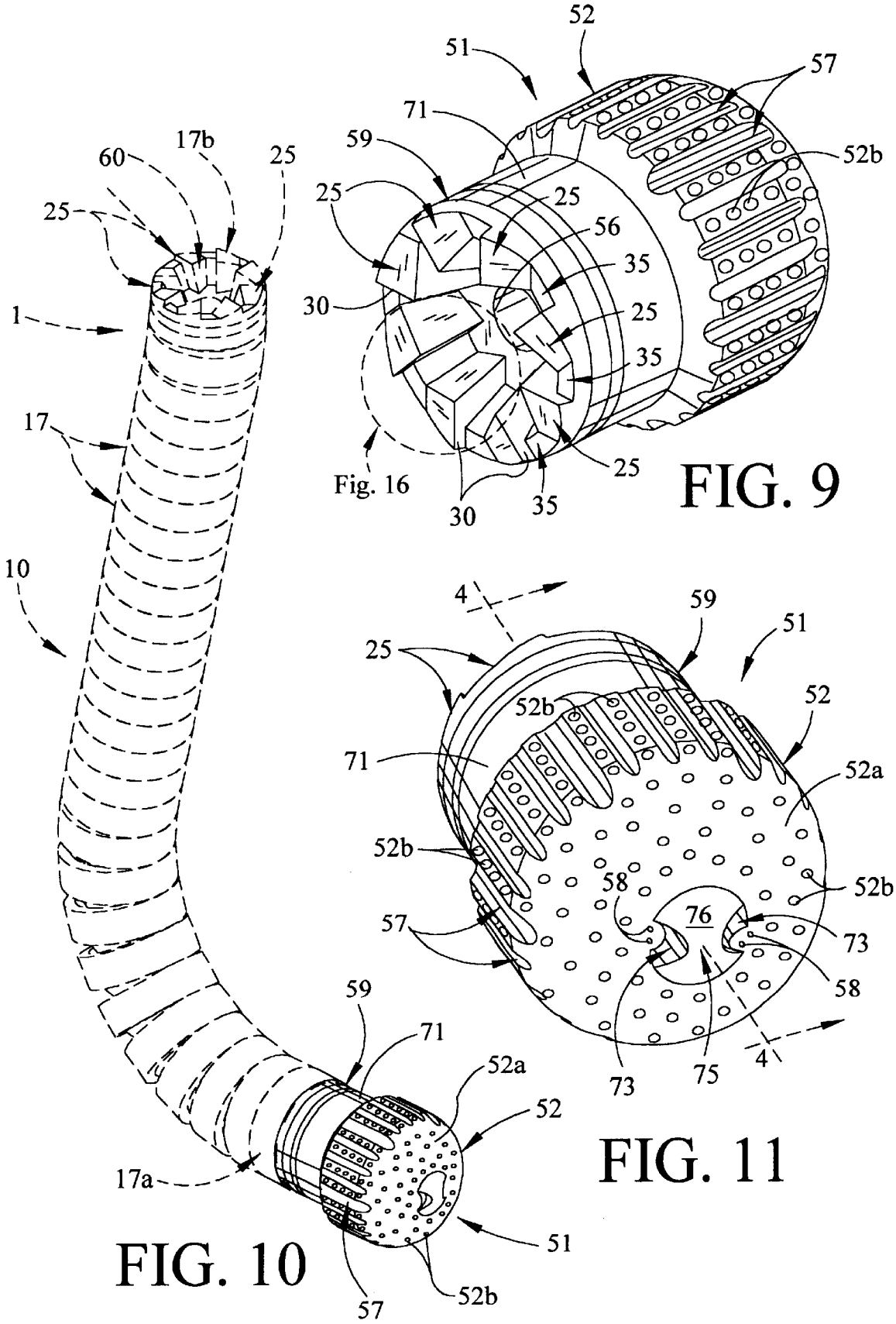
FIG. 9 is a rear perspective view of a preferred embodiment of a drill bit element of the sectional drive system of this invention.
FIG. 10 is a perspective view, illustrated in phantom, of the sectional drive system, with the drill bit illustrated in FIG. 9 mounted on the output end of the drive string of the sectional drive system.
FIG. 11 is a front perspective view of the drill bit illustrated in FIG. 9.
Figure 12:
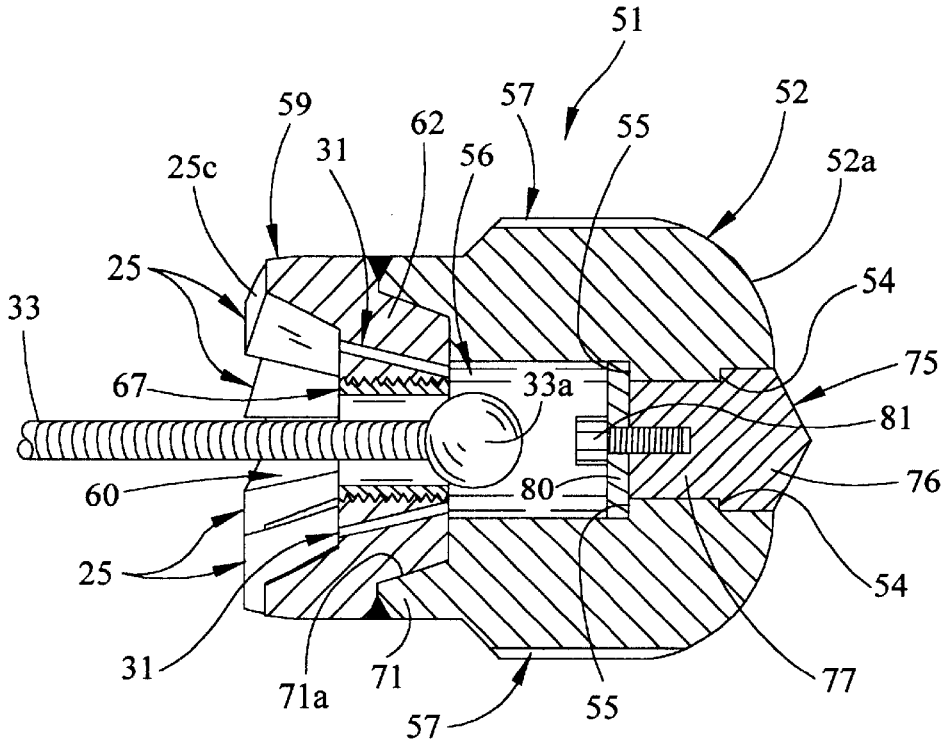
FIG. 12 is a sectional view, taken along line 12—12 in FIG. 11, of the drill bit, more particularly illustrating a preferred technique for mounting the drill bit on a segment cable extending through the drive string of the sectional drive system.
Figure 13:
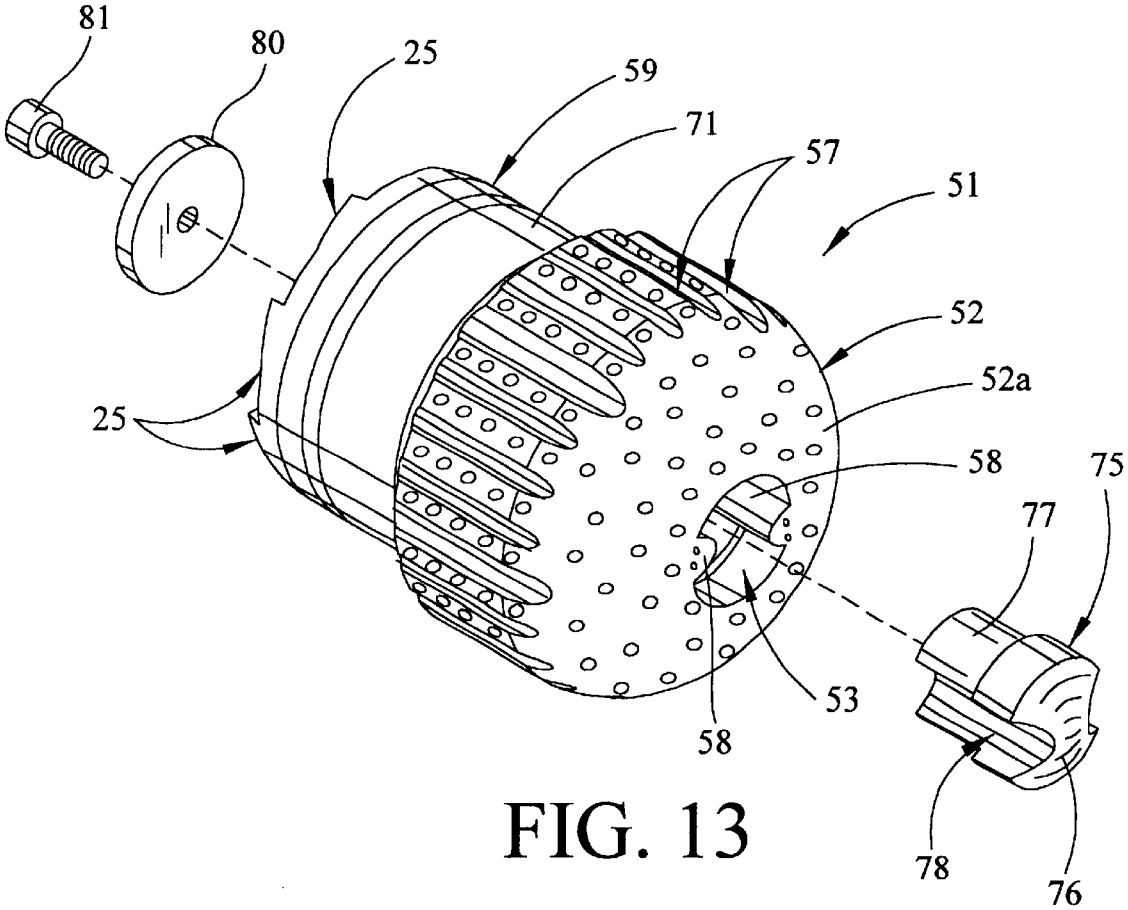
FIG. 13 is an exploded, perspective view of the drill bit, more particularly illustrating a preferred, retainer bolt and retainer washer technique for removably mounting a center bit insert in the drill bit.

Referring next to FIGS. 9–14 and 16 of the drawings, in a preferred embodiment the drill bit of this invention is generally illustrated by reference numeral 51. The drill bit 51 is designed for attachment to the drive string 10 (illustrated in phantom in FIG. 10) of the sectional drive system 1 heretofore described with respect to FIGS. 1–8, as hereinafter described. The drill bit 51 is characterized by a substantially cylindrical drill bit head 52, having a convex or dome-shaped cutting face 52*a* typically studded with multiple diamond bits 52*b* in a selected pattern, in conventional fashion. Multiple water course grooves 57 are typically provided in spaced-apart relationship in the circumference of the drill bit head 52 for facilitating passage of drilling fluid (not illustrated) between the drill bit head 52 and the well casing, cement sheath, producing interval (not illustrated) or other medium as the medium is drilled using the drill bit 51 as hereinafter described. Additional diamond bits 52*b* are typically provided on the drill bit head 52 between the water course grooves 57. As illustrated in FIG. 13, a center bit bore 53 extends centrally through the drill bit head 52 and receives a center bit insert 75 having an insert head 76 which is tapered in cross-section as illustrated in FIG. 12, and an insert shaft 77 extends from the insert head 76. Opposing drive lugs 58 of the drill bit head 52 protrude toward each other into the center bit bore 53 for engaging complementary lug grooves 78 provided in opposite sides of the insert shaft 77 and insert head 76 of the center bit insert 75. As illustrated in FIG. 12, an annular bit shoulder 54 is defined by the drill bit head 52 between broad and narrow portions of the center bit bore 53, and the insert head 76 of the center bit insert 75 seats on the bit shoulder 54 in the broad portion of the center bit bore 53 whereas the insert shaft 77 extends through the narrow portion of the center bit bore 53, beyond the bit shoulder 54. A cable ball cavity 56, the purpose of which will be hereinafter described, continues rearward extension of the narrow portion of the center bit bore 53 in the drill bit head 52, and a retaining washer shoulder 55 is defined between the cable ball cavity 56 and the smaller-diameter narrow portion of the center bit bore 53. As illustrated in FIGS. 12 and 13, the center bit insert 75 is typically removably mounted in the center bit bore 53 by means of a retaining bolt 81, extended through a retaining washer 80 and threaded into the insert shaft 77 of the center bit insert 75 with the retaining washer 80 engaging the retaining washer shoulder 55. As illustrated in FIG. 11, the lug grooves 78 (FIG. 13) of the center bit insert 75 define a lug space 73 between the center bit insert 75 and the drive lugs 58, which lug space 73 communicates with the cable ball cavity 56 of the drill bit head 52 to facilitate flow of drilling fluid (not illustrated) through the drill bit head 52 as hereinafter described.

Figure 14:
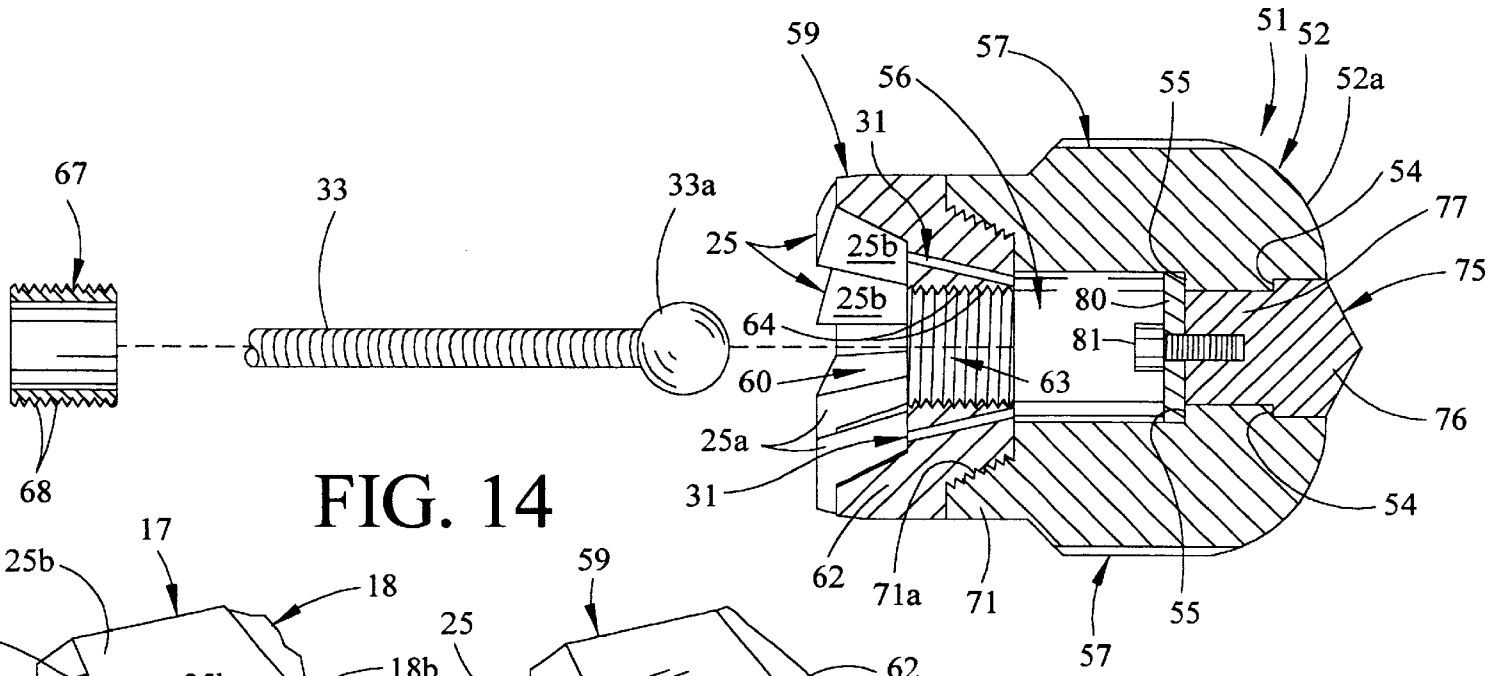
FIG. 14 is a sectional view of the drill bit, more particularly illustrating a preferred technique for mounting the drill bit on the segment cable of the sectional drive system.
Figure 16:
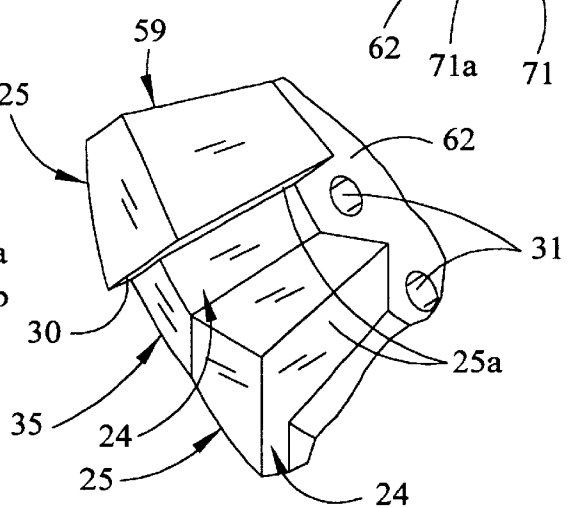
FIG. 16 is an enlarged sectional view, taken along section line 16 in FIG. 9, of the drill bit element of the sectional drive system of this invention.

As illustrated in FIGS. 12 and 14, an annular base flange 71 having a tapered interior 71*a* extends rearwardly from the drill bit head 52, and the complementary tapered base nose 62 of a cylindrical drill bit base 59 is typically threaded (FIG. 14), welded (FIG. 12) or otherwise fixedly or removably attached to the base flange 71 of the drill bit head 52 at the tapered interior 71*a*. As illustrated in FIG. 14, the drill bit base 59 includes a central bushing seat 63 which extends through the base nose 62 and is provided with multiple interior seat threads 64 and extends rearwardly from the cable ball cavity 56. Multiple, spaced-apart interior splines 25, adjacent ones of which are separated by a spline divider 35 defining an interior spline seat 24 (FIG. 16) between adjacent interior splines 25, extend rearwardly from the base nose 62 of the drill bit base 59 in surrounding relationship to a base interior 60 which communicates with the bushing seat 63. The interior spline seats 24, interior splines 25 and interor base splines 30 of the drill bit base 59 are similar in number, size and configuration to those respective elements of the drive segments 17 of the drive string 10 heretofore described with respect to FIGS. 1–8 and 15. Accordingly, the exterior splines 19 (FIG. 4) of the drive segments 17 are complementary in size and shape to the interior spline seats 24 of the drill bit base 59. Thus, the exterior splines 19 of the terminal drive segment 17*a* (FIG. 10) on the drive string 10 are capable of insertion in the complementary interior spline seats 24 between the adjacent interior splines 25 of the drill bit base 59, with the exterior base splines 28 of the terminal drive segment 17*a* engaging the respective interior base splines 30 of the drill bit base 59, to engage the respective interior splines 25 and rotate the drill bit 51 with the rotating drive string 10, as hereinafter described. As further illustrated in FIGS. 12 and 14, multiple water course passages 31 typically extend through the base nose 62 of the drill bit base 59, and communicate with the cable ball cavity 56 (which communicates with the lug spaces 73, FIG. 11) and base interior 60 to facilitate flow of drilling fluid (not illustrated) through the drill bit 1 during use as hereinafter described.

Referring again to FIGS. 10, 12 and 14 of the drawings, in typical application the drill bit 51 is typically removably mounted by means of the segment cable 33 (FIG. 1) on the drill string 10 of the sectional drive system 1, which segment cable 33 extends through the registering tip apertures 22 (FIG. 4) of the nested drive segments 17 in the drive string 10. That portion of the segment cable 33 protruding from the tip aperture 22 (FIG. 4) of the terminal drive segment 17*a* (FIG. 10) extends through a cable bushing 67 (illustrated in section in FIGS. 12 and 14) and terminates on a cable ball 33*a*, typically welded or otherwise attached to the segment cable 33. The cable ball 33*a* is extended through the threaded bushing seat 63 of the drill bit base 59 and positioned in the cable ball cavity 56 while the cable bushing 67 is threaded in the bushing seat 63 by operation of the seat threads 64 and companion bushing threads 68 on the cable bushing 67. The exterior splines 19 of the terminal drive segment 17*a* (FIG. 10) on the drive string 10 are inserted in the respective interior spline seats 24 (FIG. 16) in the base interior 60 of the drill bit 51, and the exterior base splines 28 (FIG. 5) of the terminal drive segment 17*a* engage the respective interior base splines 30 (FIG. 9) on the respective interior splines 25 of the drill bit 51. In application of the sectional drive system 1 and drill bit 51 typically according to the procedure outlined in U.S. Pat. No. 5,699,866, the drive faces 19*a* (FIG. 4) of the exterior splines 19 of the terminal drive segment 17*a* in the drive string 10 engage the drive faces 25*a* (FIG. 16) of the respective interior splines 25 of the drill bit 51 as the drive string 10 is rotated by means of the input 12 (FIG. 1). The weight of the rotating drive string 10 and other drilling components (not illustrated) engaging the input drive segment 17*b* (FIG. 10), attached to the input 12 shown in FIG. 1, bears against the drill bit 51 at the drill bit base 59 as the rotating drill bit 51 drills a perforation or drain hole (not illustrated) in a hydrocarbon-producing interval (also not illustrated). It will be appreciated from a consideration of FIG. 12 that the drill bit 51 is securely mounted on the drive string 10 since the cable ball 33*a*, having a larger diameter than that of the cable bushing 67, is prevented from pulling out of the cable ball cavity 56 by seating against the cable bushing 67 as the terminal drive segment 17*a* remains nested in the base interior 60 of the drill bit base 59.

It will be appreciated by those skilled in the art that drilling fluid (not illustrated) can be continuously circulated through the drive string 10 and attached drill bit 51 during operation of the sectional drive system 1, for purposes of cooling and preventing accumulation of drilling fragments in the drive string 10 and drill bit 51. Accordingly, the drilling fluid (not illustrated) is injected through the tip aperture 22 (FIG. 4) of the input drive section 17*b* of the drive string 10, and flows through the registering tip apertures 22 of the remaining drive segments 17 and terminal drive segment 17*a*. The drilling fluid then enters the multiple water course passages 31 of the drill bit base 59 and flows through the cable ball cavity 56 and finally, from the drill bit head 52 through the lug spaces 73 (FIG. 11). The drilling fluid is capable of removing particulate drilling fragments from the hydrocarbon-producing interval as the drilling fluid flows between the drill bit head 52 and the interval, through the water course grooves 57 in the outer circumference of the drill bit head 52.

Referring again to FIGS. 12 and 14 of the drawings, it will be appreciated by those skilled in the art that a worn or damaged center bit insert 75 of the drill bit 51 can be removed from the drill bit head 52 and replaced, as desired, by initially unthreading the cable bushing 67 from the drill bit base 59 and removing the cable ball 33*a* from the cable ball cavity 56; unthreading the retaining bolt 81 from the center bit insert 75; removing the center bit insert 75 from the drill bit head 52 and securing a replacement center bit insert 75 in the drill bit head 52 using the retaining bolt 81 and retaining washer 80; and replacing the cable bushing 67 in the drill bit base 59 and the cable ball 33*a* in the cable ball cavity 56. By increasing the "rake angle", or cutting angle, of the drill bit 51 at the center relative to the peripheral areas of the cutting face 52*a*, the center bit insert 75 enhances the cutting efficiency of the drill bit 51 relative to drill bits having a constant cutting angle across the entire diameter of the cutting face thereof. It is understood that any mechanism known to those skilled in the art other than the retaining bolt 81 and retaining washer 80 described above can be used for removably mounting the center bit insert 75 in the drill bit head 52. It is further understood that the drill bit base 59 can be constructed in one piece with the drill bit head 52 or alternatively, either removably attached to the drill bit head 52 typically at the base flange 71 typically by threaded attachment, or welded or otherwise fixedly mounted on the drill bit head 52 typically at the base flange 71.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A sectional drive system for coupling a drive to an output, comprising at least two drive segments for engaging each other and connection to the drive and the output, respectively, said at least two drive segments each comprising:

(a) a segment base having a first base surface and a second base surface;

(b) a plurality of exterior splines tapering in spaced relationship with respect to each other from said first base source of said segment base and a plurality of exterior spline seats declined between said plurality of exterior splines, respectively;

(c) a plurality of exterior base splines provided in said first base surface;

(d) a plurality of interior splines extending from said second base said of said segment base and a plurality of interior spline seats defined between said plurality of interior splines, respectively;

(e) a plurality of interior base splines provided on said plurality of interior splines, respectively; and (f) wherein said plurality of interior spline seats of a first one of said at least two drive segments receives said plurality of exterior splines of a second one of said at two drive segments, respectively; said plurality of exterior splines of said second one of said at least two drive segments engages said plurality of interior splines, respectively, of said first one of said at least two drive segments; and said plurality of exterior base splines of said second one of said at least two drive segments engages said plurality of interior base splines of said first one of said at least two drive segments, to interlock said at least two drive segments in nested relationship and connect the drive to the output.

2. The sectional drive system of claim 1 comprising an opening provided in said at least two drive segments and a connecting apparatus extending through said opening, whereby said at least two drive segments are mounted in interlocking relationship with each other on said connecting apparatus.

3. The sectional drive system of claim 1 wherein said plurality of exterior splines and said plurality of interior splines comprises eight exterior splines and eight interior splines, respectively.

4. The sectional drive system of claim 3 comprising an opening provided in said at least two drive segments and a connecting apparatus extending through said opening, whereby said at least two drive segments are mounted in interlocking relationship with each other on said connecting apparatus.

5. The sectional drive system of claim 1 wherein each of said plurality of exterior splines comprises a drive face and a spline support face, and wherein said drive face is disposed at an angle of from about 10 degrees to about 45 degrees with respect to said spline support face.

6. The sectional drive system of claim 5 comprising an opening provided in said at least two drive segments and a connecting apparatus extending through said opening, whereby said at least two drive segments are mounted in interlocking relationship with each other on said concreting apparatus.

7. The sectional drive system of claim 5 wherein said plurality of exterior splines and said plurality of interior splines comprises eight exterior splines and eight interior splines, respectively.

8. The sectional drive system of claim 7 comprising an opening provided in said at least two drive segments and a connecting apparatus extending through said opening, whereby said at least two drive segments are mounted in interlocking relationship with each other on said connecting apparatus.

9. The sectional drive system of claim 1 wherein each of said plurality of exterior splines comprises a drive face and a spline support face, and wherein said drive face of one of said plurality of exterior splines is disposed at an angle of about 45 degrees with respect to said drive face of an adjacent one of said plurality of exterior splines.

10. The sectional drive system of claim 9 comprising an opening provided in said at least two drive segments and a connecting apparatus extending through said opening, whereby said at least two drive segments are mounted in interlocking relationship with each other on said connecting apparatus.

11. The sectional drive system of claim 9 wherein said plurality of exterior splines and said plurality of interior splines comprises eight exterior splines and eight interior splines, respectively.

12. The sectional drive system of claim 11 comprising an opening provided in said at least two drive segments and a connecting apparatus extending through said opening, whereby said at least two drive segments are mounted in interlocking relationship with each other on said connecting apparatus.

13. The sectional drive system of clam 9 wherein said drive face is disposed at an angle of from about 10 degrees to about 45 degrees with respect to said spline support face.

14. The sectional drive system of claim 13 comprising an opening provided in said at least two drive segments and a connecting apparatus extending through said opening, whereby said at least two drive segments are mounted in interlocking relationship with each other on said connecting apparatus.

15. The sectional drive system of claim 13 wherein said plurality of exterior splines and said plurality of interior splines comprises eight exterior spines and eight interior splines, respectively.

16. The sectional drive system of claim 15 comprising an open provided m said at least two drive segments and a connecting apparatus extending through said opening, whereby said at least two drive segments are mounted in interlocking relationship with each other on said connecting apparatus.

17. A sectional drive system for coupling a drive to an output, comprising at least two drive segments for engaging each other and connection to the drive and the output, respectively, said at least two drive segments each comprising:

(a) a segment base having a fist base surface and a second base surface;

(b) a plurality of exterior splines tapering in spaced relationship with respect to each other from said first base surface of said segment base and an exterior spline seat defined between adjacent ones of said plurality of exterior splines;

(c) a plurality of sloped base surfaces defined in said segment base at said exterior spline seats, respectively, said plurality of sloped base surfaces disposed at an angle of from about 15 degrees to about 20 degrees with respect to said fist base surface;

(d) a plurality of exterior base splines defined by said plurality of sloped base surfaces;

(e) a plurality of interior splines extending from said second base surface of said segment base and a plurality of interior spline seats defined between adjacent ones of said plurality of interior splines, respectively, said interior spline seats including exterior seat faces, respectively, and said plurality of interior splines having exterior spline faces disposed at an angle of from about 15 degrees to about 20 degrees with respect to said exterior seat faces, respectively;

(f) a plurality of interior base splines defined by said plurality of interior splines, respectively; and (g) wherein said plurality of interior spline seats of a first one of said at least two drive segments respectively, and said plurality of exterior splines of said second one of said at least two drive segments, restively, and said plurality of exterior splines of said second one of said at least two drive segments engages said plurality of interior splines, respectively, of said first one of said at least two drive segments; and said plurality of exterior base splines of said second one of said at east two drive segments engages said plurality of interior base splines of said first one of said at least two drive segments, to interlock said at least two drive segments in nested relationship and connect the drive to the output.

18. The sectional drive system of claim 17 wherein said plurality of sloped base surfaces are disposed at an angle of about 17 degrees with respect to said first base surface, and said plurality of exterior spline faces are disposed at an angle of about 17 degrees with respect to said exterior seat faces, respectively.

19. The sectional drive system of claim 17 wherein each of said plurality of exterior splines comprises a drive face and a spline support face, and said drive face is disposed at an angle of from about 10 to about 45 degrees with respect to said spline support face.

20. The sectional drive system of claim 19 wherein said plurality of sloped base surfaces are disposed at an angle of about 17 degrees with respect to said first base surface, and said plurality of exterior spline faces are disposed at an angle of about 17 degrees with respect to said exterior seat faces, respectively.

21. A drill bit for a drive string of a sectional drive system, said drill bit comprising:

(a) a drill bit head;

(b) a center bit bore provided in said drill bit head and a center bit insert removably seated in said drill bit bore;

(c) a drill bit base provided on said drill bit head for engaging the drive string of the sectional drive system; and (d) a plurality of water course grooves provided in spaced-apart relationship in said drill bit head.

22. The drill bit of claim 21 comprising a center bit retaining mechanism removably engaging said center bit insert for retaining said center bit insert in said center bit bore.

23. The drill bit of claim 21 comprising a plurality of interior splines provided on said drill bit base for engaging the drive string.

24. The drill bit of claim 23 comprising a center bit retaining mechanism removably engaging said center bit insert for retaining said center bit insert in said center bit bore.

25. A drill bit for a drive string of a sectional drive system having a plurality of nested drive segments each provided with exterior splines and exterior base splines, said drill bit comprising:

(a) a drill bit head and a plurality of water course grooves provided in spaced-apart relationship in said drill bit head;

(b) a center bit insert provided in said drill bit head;

(c) a drill bit base provided on said drill bit head, said drill bit base having a base interior; and (d) a plurality of interior splines provided on said drill bit base in said base interior for engaging the exterior splines, respectively, of a drive segment of the drive string; and (e) a plurality of interior base splines provided on said plurality of interior splines, respectively, for engaging the exterior base splines, respectively, of a drive segment of the drive string.

26. The drill bit of claim 25 comprising:

(a) a center bit bore provided in said drill bit head, said center bit insert removably seated in said center bit bore; and (b) a center bit retaining mechanism removably engaging said center bit insert for retaining said center bit insert in said center bit bore.

27. The drill bit of claim 25 comprising an interior spline seat provided between adjacent ones of said plurality of interior splines, said interior spline seat having an exterior seat face disposed between adjacent ones of said plurality of interior splines; and said plurality of interior splines each having a drive face, a spline wall disposed at an angle with respect to said drive face and an exterior spine face disposed at an angle with respect to said exterior seat face, wherein said exterior spline face is disposed at an angle of about 15 degrees to about 20 degrees with respect to said exterior seat face.

28. A drill bit for a drive string of a sectional drive system having a plurality of nested drive segments and a segment cable extending through the drive segments, said drill bit comprising:

(a) a drill bit head having a cable ball cavity, (b) a center bit insert provided in said drill bit bead;

(c) a drill bit base provided on said drill bit head for engaging the drive string; and (d) a cable ball terminating the segment cable, said cable ball Used in said cable ball cavity for said drill bit base and attaching the segment cable to said drill bit head.

29. The drill bit of claim 28 comprising:

(a) a center bit bore provided in said drill bit head, said center bit insert removably seated in said center bit bore; and (b) a center bit retaining mechanism removably engaging said center bit insert for retaining said center bit insert in said center bit bore.

30. The drill bit of claim 28 comprising a plural of water course grooves provided in spaced-apart relationship in said drill bit head.

31. The drill bit of claim 30 comprising:

(a) a center bit bore provided in said drill bit head, said center bit insert removably seated in said center bit bore; and (b) a center bit retaining mechanism removably engaging said center bit insert for retaining said center bit in said center bit bore.

32. A sectional drive system comprising a drive string for connection to a drive mechanism, said drive string comprising:

(a) at least two drive segments for engaging each other and a segment cable extending through said drive segments;

(b) a drill bit for attachment to the drive string, said drill bit comprising a drill bit head having a cable ball cavity and a center bit insert removably mounted in said drill bit head and a drill bit base provided on said drill bit head for engaging one of said at least two drive segments of the drive string; and (c) a cable ball terminating said segment cable, said cable ball disposed in said cable ball cavity for engaging said drill bit base and attaching said segment cable to said drill bit head.

33. The sectional drive system of clam 32 wherein each of said at least two drive segments comprises:

(a) a segment base having a first surface and a second surface;

(b) a plurality of exterior splines extending from said first surface; and (c) a plurality of interior splines extending from said second surface for engaging said plurality of exterior splines, respectively, of an adjacent one of said at least two drive segments.

34. The sectional drive system of claim 33 wherein said drill bit co a plurality of interior splines extending in spaced-apart relationship with respect to each other from said drill bit base for engaging said plurality of exterior splines, respectively, of one of said at least two drive segments.

35. The sectional drive system of claim 34 wherein said drill bit comprises:

(a) a center bit bore provided in said drill bit head, said center bit insert removably seated in said center bit bore; and (b) a center bit retaining mechanism removably engaging said center bit insert for retaining said center bit insert in said center bit bore.

36. The sectional drive system of claim 34 wherein each of said at least two drive segments comprises a plurality of exterior base splines provided in said segment base and a plurality of interior base splines provided in said plurality of interior splines, respectively, and said drill bit comprises a plurality of interior base splines provided in said plurality of interior splines, respectively, of said drill bit base for engaging said plurality of exterior base splines, respectively, of one of said at least two drive segments.

37. The sectional drive system of claim 36 wherein said drill bit comprises:

(a) a center bit bore provided in said drill bit head, said center bit insert removably seated in said center bit bore; and (b) a center bit retaining mechanism removably engaging said center bit insert for retaining said center bit insert in said center bit bore.

38. The sectional drive system of claim 36 wherein said plurality of exterior splines of said each of said at least two drive segments and said plurality of exterior splines of said drill bit each comprises a drive face and a spline support face disposed at an angle with respect to said drive face, and said interior splines of said each of said at least two drive segments and said plurality of inter splines of said drill bit base each comprises a drive face and a spline wall disposed at an angle with respect to said drive face.

39. The sectional drive system of claim 38 wherein said drill bit comprises:

(a) a center bit bore provided in said drill bit head, said center bit insert removably seated in said center bit bore; and (b) a center bit retaining mechanism removably engaging said center bit insert for retaining said center bit insert in said center bit bore.

40. A The sectional drive system of clam 32 wherein said drill bit comprises:

(a) a center bit bore provided in said drill bit head, said center bit insert removably seated in said center bit bore; and (b) a center bit retaining mechanism removably engaging said center bit insert for retaining said center bit insert in said center bit bore.

41. The sectional dive system of claim 40 wherein each of said at least two drive segments comprises:

(a) a segment base having a first surface and a second surface;

(b) a plurality of exterior splines extending from said first surface; and (c) a plurality of interior splines extending from said second surface for engaging said plurality of exterior splines, respectively, of an adjacent one of said at least two drive segments.

* * * * *